United States Patent [19]

Muszkiewicz

[11] 4,169,252

[45] Sep. 25, 1979

[54] INDIVIDUALLY PACKAGED MAGNETICALLY TUNABLE RESONATORS AND METHOD OF CONSTRUCTION

[75] Inventor: Robert P. Muszkiewicz, Tempe, Ariz.

[73] Assignee: Motorola, Inc., Schaumburg, Ill.

[21] Appl. No.: 903,295

[22] Filed: May 5, 1978

[51] Int. Cl.[2] ..... H01P 1/20; H01P 7/00

[52] U.S. Cl. ..... 333/205; 333/167; 333/223

[58] Field of Search ..... 333/73 R, 73 C, 73 W, 333/73 S, 82 B, 82 R, 83

[56] References Cited

U.S. PATENT DOCUMENTS

| | | | |
|---|---|---|---|
| 3,221,276 | 11/1965 | Stern | 333/83 R |
| 3,408,599 | 10/1968 | Horton et al. | 333/73 R |
| 3,448,409 | 6/1969 | Moose et al. | 333/73 S |
| 3,458,837 | 7/1969 | Ngo | 333/73 C |
| 3,539,953 | 11/1970 | Jones | 333/73 |
| 3,671,883 | 6/1972 | Szente et al. | 333/73 R |
| 3,681,716 | 8/1972 | Chiron et al. | 333/73 S |
| 3,748,605 | 7/1973 | Baynham et al. | 333/73 W |
| 3,766,494 | 10/1973 | Anbe et al. | 333/82 B |
| 4,020,429 | 4/1977 | Bickley | 333/73 R |

FOREIGN PATENT DOCUMENTS

| | | | |
|---|---|---|---|
| 208045 | 3/1968 | U.S.S.R. | 333/82 B |

*Primary Examiner*—Alfred E. Smith
*Assistant Examiner*—Harry E. Barlow
*Attorney, Agent, or Firm*—M. David Shapiro; Eugene A. Parsons

[57] ABSTRACT

A building block resonator is fabricated using a single chemically milled copper pattern and two pieces of garnet material to form a quarter-wave transmission line which is shorted at one end. Tuning is achieved with an electromagnet by varying the static magnetic field perpendicular to the resonator which causes the permeability of the garnet material to change. Resonators formed in this manner can be cascaded in any number to form a multi-pole filter. Narrow band UHF filters (0.5 percent 3 dB bandwidth at 225–400 megahertz) can be built in a very compact form. The magnetic tuning field intensities used are above the saturation point of the garnet, and high power level operation devoid of non-linear effects is possible.

11 Claims, 11 Drawing Figures

INDIVIDUALLY PACKAGED MAGNETICALLY TUNABLE RESONATORS AND METHOD OF CONSTRUCTION

BACKGROUND OF THE INVENTION

This invention relates to microwave resonators or filters, and more particularly, to magnetically tunable filters.

Magnetically tunable filters which use a ferromagnetic material such as yttrium-iron-garnet (YIG) are well known in the art. Generally these filters operate in the gigahertz range and involve multiple conductors on a single ferromagnetic substrate to provide the coupling and filter characteristics of the device. However these structures have several electrical and physical drawbacks when utilized at UHF (225–400 MHz) frequencies.

The electrical limitations include a practical limitation on the number of filter poles obtainable by simple cascading of individual resonators. Most prior art magnetically tuned filters are limited to a two pole configuration. Also the general bandpass characteristics are fairly broad and uneven across the frequency range of the filter. Thus a 10 megahertz bandwidth is considered state-of-the-art in most present magnetically tunable filters operating at UHF frequencies. Moreover, the bandpass characteristics generally change appreciably over the frequency range of the filter, being very narrow at one end and very broad at the other end of the frequency range.

The physical limitations of the present magnetically tuned filters arise from the characteristics of the ferromagnetic material. The ferromagnetic material by its very nature is highly influenced physically by an applied magnetic field. Thus the ferromagnetic material will experience an attractive force toward one of the pole pieces of a magnet. This ferromagnetic material is positioned between the center electrical conductor and the ground plane in usually a microstrip or stripline configuration. Movement of the ferromagnetic material by a magnetic field tends to displace the physical location of the center conductor with respect to the ground plane which in turn causes an uneven change in the electrical characteristics of the filter. Also since the commonly used yttrium-iron-garnet material tends to be brittle like glass, trying to tightly clamp the YIG material in place so as to prevent movement can result in a cracking of the YIG material.

Thus it can be appreciated that a UHF magnetically tuned resonator which is cascadable, which can be formed into narrow band filters with constant bandwidth over the frequency range, and is fairly easy to manufacture is highly desirable.

SUMMARY OF THE INVENTION

It is therefore an object of this invention to provide a magnetically tuned resonator which is fairly simple and inexpensive to fabricate.

It is also an object of this invention to provide a magnetically tuned resonator which can be cascaded directly to provide multiple pole response characteristics.

It is also an object of this invention to provide a resonator which is a basic building block of a narrow band tunable filter.

It is still another object of this invention to provide a magnetically tunable resonator which is capable of handling high power level control.

It is also an object of this invention to provide a magnetically tuned resonator which is cascadable to provide a variety of filter response characteristics.

It is a further object of this invention to provide a method for fabricating a magnetically tunable multipole filter which is fairly simple to make.

It is still another object of this invention to provide a method for fabricating a magnetically tunable resonator which can be cascaded to provide a variety of filter response characteristics.

An illustrated embodiment of the invention provides an independent magnetically tunable resonator having at least one conductive element and at least one ferromagnetic element held in close proximity to each other by conductive securing means which substantially wraps around said conductive element and said ferromagnetic element to form a single magnetically tunable resonator.

Also provided is a method of fabricating a tunable resonator which comprises the steps of substantially enclosing an electrical conductor and a ferromagnetic material in a metallic box for holding said ferromagnetic material in close proximity to said electrical conductor.

DESCRIPTION OF THE PREFERRED EMBODIMENTS

Figure 1:
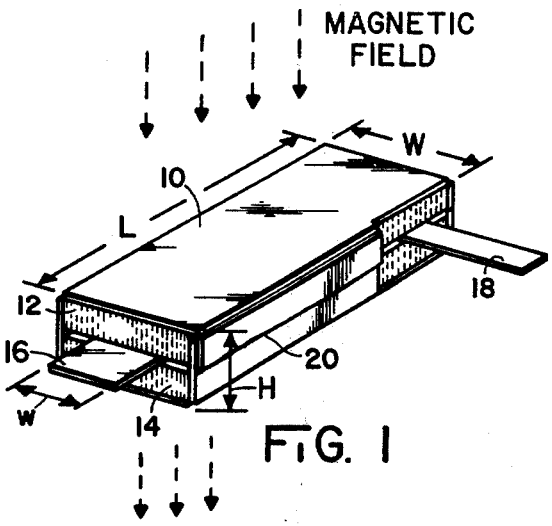
FIG. 1 is a view in perspective of a magnetically tunable resonator embodying the present invention. p

Now referring to FIG. 1, a magnetically tunable resonator is depicted which has an outer metallic box 10 which substantially surrounds an upper garnet material 12, a lower garnet material 14 and a center conductor 16 which is positioned between garnet material 12 and 14. A connecting stub 18 extends through an aperture in the metal box 10 and connects to the center conductor 16 between the two garnet material pieces. A solder seam 20 on one side of the resonator structure forms a longitudinal seam of the metal box 10. Metal box 10 operates as a ground plane to enclose the garnet material 12 and 14 and center conductor 16 in a stripline configuration.

Figure 2:
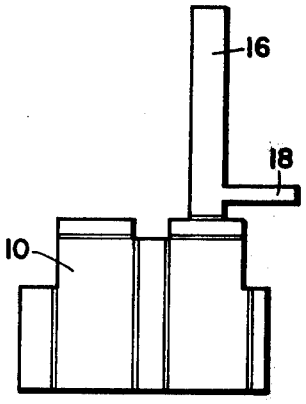
FIG. 2 is a plan view of a portion of the resonator or blank of FIG. 1.
Figure 3:
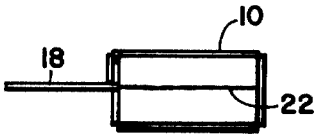
FIG. 3 is a view of the end of the resonator of FIG. 1 not shown in FIG. 1.

As will be shown with reference to FIG. 3, center conductor 16 is shorted to metal box 10 at the end closet to the stub 18. Since in the preferred embodiment the center conductor is a quarter wavelength long, the module forms a shorted quarter wavelength resonator. The garnet material 12 and 14 may be other common ferrite or ferromagnetic materials commonly used in magnetically tunable filters such as Permalloy, nickel iron compounds, or equivalents thereof. In the preferred embodiment, the resonator has a longitudinal length, L, of 1 inch, a height, H, of a quarter inch and a width, W, of a half inch. The center conductor 16 has a width, w, of a quarter inch and each garnet dielectric 12 and 14, has a thickness of 0.1 inches. The silver plated copper sheet metal (see FIG. 2) has a nominal thickness of 0.010 inches. The preferred embodiment which operates in the frequency range of 225 to 300 megahertz, has a 20 picofarad capacitor (not shown) attached to the non-shorted end of the center conductor 16. The physics of the operation of the tunability of the garnet material is well understood by those in the art and, therefore, will not be discussed at length herein. See for example U.S. Pat. No. 4,020,429 by Robert Bickley for a discussion of the physics of operation wherein the magnetic bias field is greater than the saturation level of the YIG material to provide linear operation of the filter under high power level conditions. These same principles are applied to this embodiment to provide a high power level operation.

FIG. 2 is an unfolded layout or blank of the metallic box 10 and center conductor 16 of FIG. 1. The interior double lines indicate fold lines which if properly made, and with the inclusion of a garnet material, will produce the module of FIG. 1. Thus it can be seen that the fabrication of this magnetically tuned resonator is fairly simple, since both the outside ground plane material and the inner conductor can be fabricated at a single chemically milled operation. This chemical milling has the advantage of being well controlled and fold lines can be etched into the material to provide fairly simple fabrication of the completed module.

FIG. 3 is an end view of the resonator of FIG. 1 showing a rear solder seal 22 which completely encloses the shorted end of the inner conductor in the garnet material. These two solder seams 20 of FIG. 1 and 22 of FIG. 3 are required to complete the fabrication of the resonator. In the preferred method of fabrication, the sheet metal blank is folded around the garnet material and then clamped lightly in a vise to compress the structure. The solder seams (20 of FIG. 1 and 22 of FIG. 3) are then made. When the resonator is removed from the vise, the metal box is then under tension to hold the garnet material and center conductor securely in place.

Figure 4:
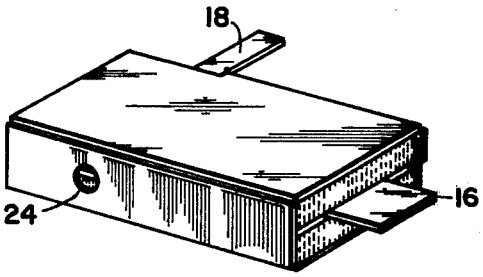
FIG. 4 is a view in perspective of the resonator of FIG. 1 showing a side not shown in FIG. 1.

FIG. 4 is a perspective view of the resonator, illustrating the side not seen in FIG. 1, wherein an aperture 24 has been cut in the side of the metal enclosure to provide another access to the inner conductor 16 for use if necessary in cascading of several stripline filters. The use of a circular aperture 24 provides nearly constant bandwidth coupling across the tuning range. Note that there are many different methods of coupling into and out of the resonator as will be well understood by those skilled in the art. For example stud 18 can be used as an input or an output port, the unshorted end of the center conductor 16 can be used as an input or an output, and a combination magnetic field and electrical field coupling can also be used as a means of coupling energy into and out of the resonator. Thus there is a great variety of different configurations which can be used that are standard in filter construction.

The direction of the magnetic field for the resonator of FIG. 1 is perpendicular to the largest surfaces of the module such that the magnetic flux passes through the sandwich structure of the garnet material 12, inner conductor 16 and second garnet material 14 respectively as indicated by the broken arrows in FIG. 1.

Figure 5:
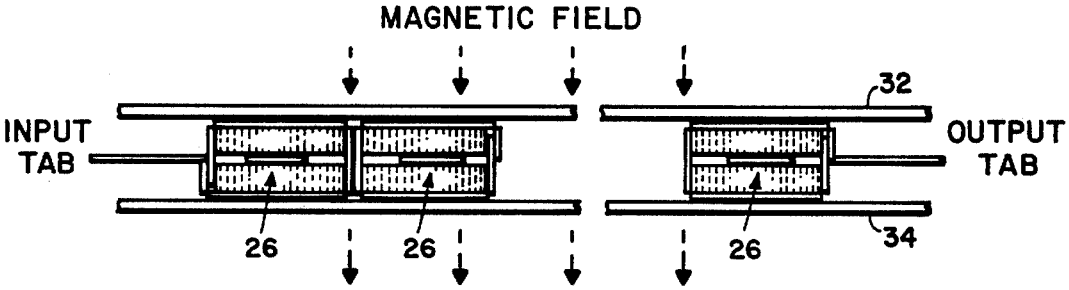
FIG. 5 is a drawing of a cascaded arrangement of magnetically tunable resonators constituting a multipole filter.
Figure 6A:
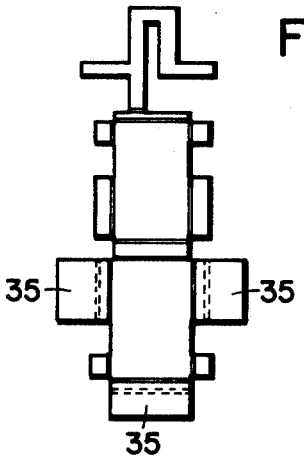
FIG. 6A depicts a metal box blank and inner conductor for an additional embodiment of the invention.
Figure 6B:
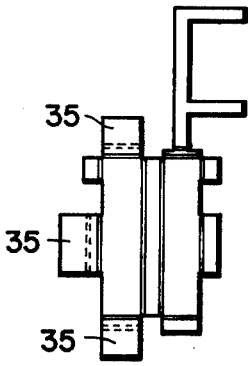
FIG. 6B depicts a metal box blank and inner conductor for another additional embodiment of the invention.
Figure 6C:
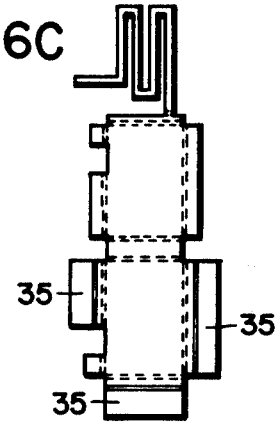
FIG. 6C depicts a metal box blank and inner conductor for yet another additional embodiment of the invention.
Figure 6D:
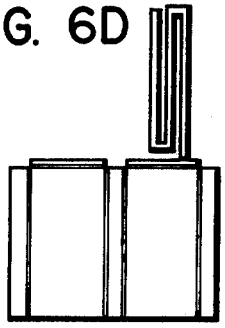
FIG. 6D depicts a metal box blank and inner conductor for still another additional embodiment of the invention.

FIG. 5 illustrates an end view of a cascaded arrangement of resonators of FIG. 1. Resonators 26 are laid side by side and coupling is accomplished between successive resonators either by a coupling aperture such as shown as aperture 24 in FIG. 4 or by any of other common stripline techniques as mentioned above. Common magnetic source pole pieces 32 and 34 can be laid across each side of the resonators prependicular to the magnetic field to provide even distribution of the magnetic field across each of the resonators. Since each of the resonators operates independently, it is possible to cascade any number of resonators to form a multiple filter and also to tune each resonator to a different frequency if desirable to produce almost any of the known stripline filter characteristics. Also it is important to note that each of the resonators has its own ground plane, and thus physical shifting between the resonators will not affect the circuit performance appreciably. That is, the metallic sheet metal ground plane 10 surrounding each resonator holds each garnet material in close proximity to the center conductor for each resonator and thus each module operates independent of the other modules. Since the metallic sheet metal forms a tight box, the tension of the metal itself provides a slight tension on the garnet material but not enough to crack or damage the garnet material.

FIGS. 6A–6D indicates four additional embodiments of the outside metallic box and inner conductor layout as shown in FIG. 2 of the preferred embodiment. Illustrated are several of the many varieties which can be used to achieve different frequency range characteristics, and to provide more access points to the inner conductor if necessary. The blanks 6A, 6B, and 6C also provide tabs 35 which extend from the completed resonator for mounting the resonator on a circuit board.

Figure 7:
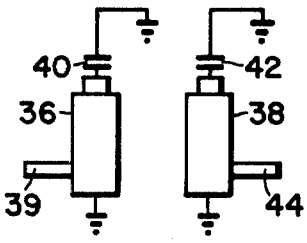
FIG. 7 is a circuit diagram of two cascaded magnetically tunable resonators.
Figure 8:
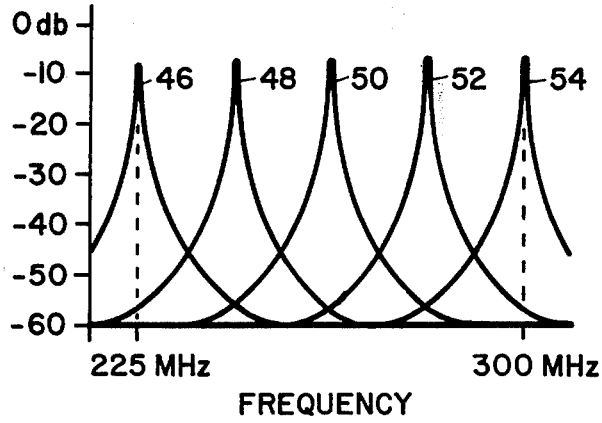
FIG. 8 shows the response curves of the circuit of FIG. 7.

FIG. 7 shows a double resonator built out of two resonators 36 and 38, both of which are identical to the resonator shown in FIG. 1 with 20 pf loading capacitors 40 and 42 connected to the unshorted end of the center conductors of resonators 36 and 38 respectively. An input signal into the stub of resonator 36 is filtered by both resonators and their associated 20 picofarad loading capacitors 40 and 42, to provide a filtered signal at the output of the stub 44 of resonator 38. An input signal into stub 39 of resonator 36 is filtered by the resonator 36 and the signal is transferred by the E field produced at the unshorted end of the center conductor of resonator 36 to the unshorted end of the inner conductor of resonator 38 and filtered again by the single pole characteristic of resonator 38 and transferred to the output stub 44. FIG. 8 indicates the filter response of the circuit of FIG. 7 for 5 different applied magnetic fields to the filter. The first filter response 46 has a center frequency of 225 magahertz and a 3 dB bandwidth of approximately 2 megahertz. Increasing the magnetic field produces the filter response as shown as plots 48, 50, 52, and 54 respectively which together with plot 46 cover the frequency range of 225 to 300 megahertz. Note that for each of the curves, the 3 dB bandwidth is held constant at approximately 2 megahertz and the insertion loss is also constant at about 6½ dB. Thus the filter characteristics remain essentially constant over the tuning frequency range of the resonators, and by simple cascading of two single pole resonators, a double pole filter response is achieved. This represents a bandwidth of approximately 0.5 percent which is a distinct improvement over prior art magnetically tunable filters operating at the same frequency range.

While the invention has been particularly shown and described with reference to the preferred embodiments shown, it will be understood by those skilled in the art that various changes may be made therein without departing from the teachings of the invention. Therefore, it is intended in the appended claims to cover all such equivalent variations as come within the spirit and scope of the invention.

What is claimed is:

1. A magnetically tunable resonator comprising:
(a) at least one electrical conductor;
(b) ferrite substrate means for providing a variable magnetic permeability therein disposed on at least one side of said electrical conductor; and
(c) conductive securing means for substantially wrapping around and holding said ferrite substrate means in close proximity of said electrical conductor for providing a magnetically tunable resonator.

2. A magnetically tunable resonator as set forth in claim 1 wherein said ferrite substrate means is yttrium-iron-garnet.

3. A magnetically tunable resonator as set forth in claim 2 wherein said yttrium-iron-garnet is magnetically biased above its saturation point.

4. A tunable filter comprising:
(a) a plurality of magnetically tuned resonators each having at least one conductive element and at least one ferromagnetic element held in close proximity to each other by a conductive securing means which substantially wraps around and compresses said ferromagnetic element, at least two of said securing means being adjacent each to the other, said at least two of said securing means having coaligned aperture means therein for transferring energy between said resonators; and
(b) magnetic biasing means for providing a magnetic field in said ferromagnetic elements for controlling the permeability in said ferromagnetic elements to produce a magnetically tunable filter.

5. A magnetically tunable resonator comprising:
(a) a quarter wavelength conductor having an input stub attached thereto;
(b) a first and second block of yttrium-iron-garnet (YIG) material disposed on either side of said conductor; and
(c) a sheet metal enclosure under tension which substantially surrounds and secures said conductor into close proximity to said YIG material to provide a ground plane shorted to one end of said conductor, said metal enclosure having openings for said input stub and an unshorted end of said conductor.

6. A magnetically tunable resonator as set forth in claim 5 further comprising a magnetic biasing means responsive to an electric current for applying a magnetic field to said YIG material to thereby tune the resonator.

7. An electrically tunable resonator as set forth in claim 5 further including a capacitor attached to said unshorted end of said conductor.

8. A method of fabricating a magnetically tunable resonator comprising the steps of:
(a) providing an electrical conductor;
(b) providing at least one ferromagnetic material; and
(c) substantially enclosing and compressing said conductor and said ferromagnetic material in a sheet metallic box under tension for holding said ferromagnetic material in close proximity to said electrical conductor.

9. A method of fabricating a tunable filter comprising the steps of:
(a) providing a plurality of tunable resonators, each of said resonators being constructed by substantially enclosing and compressing an electrical conductor and a ferromagnetic material in a sheet metal box for holding said ferromagnetic material in close proximity to said electrical conductor, each of said sheet metal boxes having an aperture therein; and
(b) interconnecting said resonators by means of coalignment of said apertures to pass electrical signals from at least one of said resonators to at least one other of said resonators.

10. A method of fabricating a high power tunable resonator comprising the steps of:
(a) sandwiching a quarter wavelength conductor between two slabs of yttrium-iron-garnet (YIG) material, said conductor having an input stub attached thereto; and
(b) substantially enclosing and compressing said sandwiched structure in a sheet metal box for holding said YIG material in close proximity to said conductor wherein said sheet metal is under tension and forms a ground plane for the resonator and is connected to one end of said conductor, said metallic box further containing apertures for exposing said input stub and said unshorted end of said conductor.

11. A method of fabricating a magnetically tunable resonator comprising the steps of:
(a) providing a sheet metal box blank with a center conductor attached at one end;
(b) providing two pieces of ferromagnetic material; and
(c) forming said box blank into a box which encloses said pieces of ferromagnetic material, said pieces of ferromagnetic material separated by said inner conductor.

* * * * *